US012710208B2

(12) United States Patent
Aschow et al.

(10) Patent No.: US 12,710,208 B2
(45) Date of Patent: Aug. 18, 2026

(54) SYSTEMS AND METHODS FOR A REFRIGERATION SYSTEM WITH INDIRECT EVAPORATIVE HEAT EXCHANGER

(71) Applicant: Effecterra, Inc., Reno, NV (US)

(72) Inventors: Evan Aschow, Fair Oaks, CA (US); Michael May, Reno, NV (US)

(73) Assignee: EFFECTERRA, INC., Reno, NV (US)

( * ) Notice: Subject to any disclaimer, the term of this patent is extended or adjusted under 35 U.S.C. 154(b) by 354 days.

(21) Appl. No.: 18/393,271

(22) Filed: Dec. 21, 2023

(65) Prior Publication Data

US 2024/0280304 A1 Aug. 22, 2024

Related U.S. Application Data

(60) Provisional application No. 63/446,138, filed on Feb. 16, 2023.

(51) Int. Cl.
*F25B 49/02* (2006.01)

(52) U.S. Cl.
CPC .... *F25B 49/027* (2013.01); *F25B 2700/2106* (2013.01)

(58) Field of Classification Search
CPC . F25B 2700/2106; F25B 39/04; F25B 49/027
See application file for complete search history.

(56) References Cited

U.S. PATENT DOCUMENTS

2011/0126564 A1* 6/2011 Anandhakrishnan ..... F28D 5/00 62/304
2011/0296857 A1* 12/2011 Kim ..... F24F 11/30 62/89
2014/0209279 A1* 7/2014 Aaron ..... F28D 5/02 165/104.13
2019/0128544 A1* 5/2019 Sloan ..... F25B 49/02
2020/0080787 A1* 3/2020 Fisher ..... H05K 7/20745
2021/0341155 A1* 11/2021 Brill ..... F24F 1/0083
2023/0304680 A1* 9/2023 Yu ..... F25B 41/39
2024/0391300 A1* 11/2024 Dziubinschi ..... F25B 43/006

OTHER PUBLICATIONS

Belusko et al., "Performance Evaluation of a CO2 Refrigeration System Enhanced with a Dew Point Cooler", Energies, (2019), 12, 1079, pp. 1-21.

* cited by examiner

*Primary Examiner* — Henry T Crenshaw
(74) *Attorney, Agent, or Firm* — Foley & Lardner LLP

(57) ABSTRACT

A method for controlling a condenser unit that includes an indirect evaporative heat exchanger for pre-cooling air from ambient before the air is provided to a condenser coil includes identifying a determination that the indirect evaporative heat exchanger should be activated. The method also includes obtaining a temperature of the pre-cooled air that exits the indirect evaporative heat exchanger for cooling the condenser coil and modulating a vent that controls a portion of the pre-cooled air that is recirculated through the indirect evaporative heat exchanger through multiple wet channels such that the temperature of the pre-cooled air is maintained at least a predetermined amount above a dew point temperature.

20 Claims, 9 Drawing Sheets

SYSTEMS AND METHODS FOR A REFRIGERATION SYSTEM WITH INDIRECT EVAPORATIVE HEAT EXCHANGER

CROSS-REFERENCE TO RELATED APPLICATIONS

This application claims the benefit and priority to U.S. Provisional Application No. 63/446,138, filed on Feb. 16, 2023, which is incorporated herein by reference in its entirety.

BACKGROUND

The present disclosure relates generally to refrigeration systems. More particularly, the present disclosure relates to techniques for improving the coefficient of performance of a refrigeration system.

SUMMARY

One implementation of the present disclosure is a refrigeration system, according to some embodiments. In some embodiments, the refrigeration system includes a condenser unit including a condensing coil, an indirect evaporative heat exchanger, a fan, multiple louvres, and a controller. In some embodiments, the condenser unit is configured to receive warm refrigerant, condense and cool the warm refrigerant, and provide cooled refrigerant as an output. In some embodiments, the condensing coil is configured to receive the warm refrigerant and output the cooled refrigerant as the output. In some embodiments, the indirect evaporative heat exchanger is configured to receive air from ambient, and discharge cooled air to the condensing coil. In some embodiments, the indirect evaporative heat exchanger includes multiple dry channels configured to deliver outlet air to an intermediate volume, and multiple wetted channels configured to recirculate a portion of the outlet air and discharge exhaust air into an exhaust space. In some embodiments, the fan is positioned above a vent. In some embodiments, the fan is configured to draw an airflow of the portion of the outlet air through the intermediate volume, across the condensing coil, into a central inner volume, and out of the condenser unit as condenser exhaust air. In some embodiments, the multiple louvres are adjustable between an at least partially open position and a closed position. In some embodiments, the louvres define a boundary between the exhaust space and the central inner volume. In some embodiments, the controller is configured to operate the louvres to transition between the at least partially open position and the closed position based on a temperature reading of the ambient. In some embodiments, the controller is configured to modulate the louvres between the at least partially open position and a fully open position to control cooling of the refrigerant that passes through the condensing coil.

In some embodiments, when the louvres are in the at least partially open position, the fan draws the exhaust air from the exhaust space, between the louvres, and discharges the exhaust air as a portion of the condenser exhaust air out of the condenser unit. In some embodiments, operation of the fan is configured to drive the recirculation of the portion of the outlet air through the wetted channels and into the exhaust space to induce indirect evaporative cooling of the air received from the ambient that travels through the dry channels. In some embodiments, the louvres are infinitely variable between the fully open position and the closed position.

In some embodiments, the controller is configured to compare a temperature of the ambient to a threshold temperature. In some embodiments, responsive to the temperature of the ambient exceeding the threshold temperature, the controller is configured to operate a water tank to provide moisture to the wetted channels, and operate an actuator to transition the louvres into the fully open position. In some embodiments, responsive to the temperature of the ambient being less than the threshold temperature, the controller is configured to operate the water tank to stop providing the moisture to the plurality of wetted channels and operate the actuator to transition the louvres into the closed position.

In some embodiments, the controller is configured to obtain a temperature of the ambient and a humidity of the ambient, and determine a dew point temperature of the ambient based on the temperature and the humidity of the ambient. In some embodiments, the controller is configured to determine an ambient dew point depression based on a difference between the dew point temperature and the temperature of the ambient. In some embodiments, the controller is configured to compare the ambient dew point depression to a threshold dew point depression, and responsive to the ambient dew point depression exceeding the threshold dew point depression, operate a water tank to provide moisture to the wetted channels, and operate an actuator to transition the louvres into the fully open position. In some embodiments, responsive to the ambient dew point depression being less than the threshold dew point depression, the controller is configured to operate the water tank to stop providing the moisture to the wetted channels and operate the actuator to transition the louvres into the closed position.

In some embodiments, the controller is configured to obtain a temperature of the ambient and a humidity of the ambient. In some embodiments, the controller is configured to determine a dew point temperature of the ambient based on the temperature and the humidity of the ambient. In some embodiments, the controller is configured to determine an ambient dew point depression based on a difference between the dew point temperature and the temperature of the ambient. In some embodiments, the controller is configured to compare the ambient dew point depression to a threshold dew point depression, and compare the temperature of the ambient to a threshold temperature. In some embodiments, the controller is configured to operate a water tank to provide moisture to the wetted channels and operate an actuator to adjust the louvres between the fully open position and the at least partially open position responsive to either (i) the ambient dew point depression exceeding the threshold dew point depression or (ii) the temperature of the ambient exceeding the threshold temperature. In some embodiments, the controller is configured to operate the water tank to stop providing the moisture to the plurality of wetted channels and operate the actuator to transition the louvres into the closed position responsive to both (i) the ambient dew point depression being less than the threshold dew point depression and (ii) the temperature of the ambient being less than the threshold temperature.

In some embodiments, operating the actuator to adjust the louvres between the fully open position and the at least partially open position comprises includes obtaining an entering air temperature of the outlet air in the intermediate volume prior to the outlet air being provided to the condensing coil, and modulating the actuator to continuously adjust a position of the plurality of louvres between the fully open position and the at least partially open position to maintain the entering air temperature at a desired temperature value to control the cooling of the refrigerant that passes through the condensing coil. In some embodiments, the desired temperature value is a sum of the dew point temperature and an offset temperature amount.

Another implementation of the present disclosure is a control system for a condenser, according to some embodiments. In some embodiments, the control system includes an actuator and processing circuitry. In some embodiments, the actuator is configured to adjust a position of a louvre that is continuously adjustable between a fully closed position and a fully open position to adjust an amount of airflow that is recirculated through an indirect evaporative heat exchanger. In some embodiments, the indirect evaporative heat exchanger is positioned along a flow path between an external area and a cooling coil of the condenser. In some embodiments, the indirect evaporative heat exchanger is configured to discharge a first airflow of cooled air to the cooling coil, and a second airflow of exhaust air to the vent. In some embodiments, the processing circuitry is configured to obtain a temperature of air in the external area, and responsive to the temperature of the air in the external area being greater than a threshold temperature, operate a water tank to provide moisture to multiple wetted channels of the indirect evaporative heat exchanger, and operate the actuator to transition the vent into the fully open position.

In some embodiments, the processing circuitry is configured to, in response to the temperature of the external area being less than the threshold temperature, operate the water tank to stop providing the moisture to the plurality of wetted channels, and operate the actuator to transition the vent into the fully closed position.

In some embodiments, the processing circuitry is configured to obtain a relative humidity of the air in the external area, and obtain a dew point temperature of the air in the external area based on the relative humidity and the temperature of the air in the external area. In some embodiments, the processing circuitry is configured to determine an ambient dew point depression based on the temperature of the air in the external area and the dew point temperature, and responsive to the ambient dew point depression exceeding a threshold dew point depression, operate the water tank to provide the moisture to the plurality of wetted channels of the indirect evaporative heat exchanger and operate the actuator to transition the vent into the fully open position.

In some embodiments, in response to either (a) the temperature of the air in the external area being greater than the threshold temperature, or (b) the ambient dew point depression exceeding the threshold dew point depression, the processing circuitry is configured to operate the water tank to provide the moisture to the wetted channels of the indirect evaporative heat exchanger, and operate the actuator to transition the vent into the fully open position.

In some embodiments, the processing circuitry is further configured to obtain a temperature of the first airflow before the first airflow is provided to the cooling coil, and modulate operation of the actuator to continuously adjust the vent between different open positions to maintain the temperature of the first airflow at a desired temperature. In some embodiments, the desired temperature is a temperature that achieves a desired coefficient of performance of a refrigeration system of the condenser. In some embodiments, the desired temperature includes a dew point temperature of the air in the external area offset by a predetermined amount such that the first airflow is maintained the predetermined amount above the dew point temperature.

Another implementation of the present disclosure is a method for controlling a condenser unit that includes an indirect evaporative heat exchanger for pre-cooling air from ambient before the air is provided to a condenser coil, according to some embodiments. In some embodiments, the method includes, responsive to a determination that the indirect evaporative heat exchanger should be activated, obtaining a temperature of the pre-cooled air that exits the indirect evaporative heat exchanger for cooling the condenser coil. In some embodiments, the method further includes modulating a vent that controls a portion of the pre-cooled air that is recirculated through the indirect evaporative heat exchanger through multiple wet channels such that the temperature of the pre-cooled air is maintained at least a predetermined amount above a dew point temperature.

In some embodiments, the determination that the indirect evaporative heat exchanger should be activated includes determining at least one of (a) that a temperature of ambient air exceeds a threshold temperature, or (b) that a dew point depression exceeds a threshold dew point depression. In some embodiments, the dew point temperature is a current dew point temperature of ambient air. In some embodiments, the method further includes, responsive to the determination that the indirect evaporative heat exchanger should be activated, activating a water tank to provide moisture to the wetted channels. In some embodiments, the recirculation of the pre-cooled air through the wetted channels induces indirect evaporative cooling of air travelling through multiple dry channels of the indirect evaporative heat exchanger. In some embodiments, modulating the vent includes performing a closed loop control scheme to maintain the temperature of the pre-cooled air at least the predetermined amount above the dew point temperature.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the Figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the FIGURES, a refrigeration unit or system includes a condenser that is configured to receive warm or hot refrigerant (e.g., coolant) and condense/cool the refrigerant. In some embodiments, the condenser includes condenser coils through which the refrigerant is configured to flow to thereby condense and cool the refrigerant. The cooled refrigerant can be passed through an expansion valve and used in an evaporator to cool a space (e.g., to absorb heat from the space). In some embodiments, the condenser includes an indirect evaporative heat exchanger that is positioned downstream of an inlet to ambient or outdoor air, and upstream of the condenser coils. In some embodiments, the indirect evaporative heat exchanger is controlled to pre-cool or pre-condition the air that is drawn from ambient before the air is provided over the condenser coils. In some embodiments, the indirect evaporative heat exchanger includes dry passages through which air that is provided to the condenser coils flows. The indirect evaporative heat exchanger can also include wet passages such that a portion of air that exits the dry passages is recirculated into the wet passages and facilitates indirect evaporative cooling of the air travelling through the dry passages. Advantageously, the indirect evaporative heat exchanger facilitates improved pre-cooling of the air before the air is used to condense the refrigerant passing through the refrigeration coils, which in turn improves efficiency of the condenser, and improves the coefficient of performance (COP) of the refrigeration unit.

Refrigeration System

Figure 1:
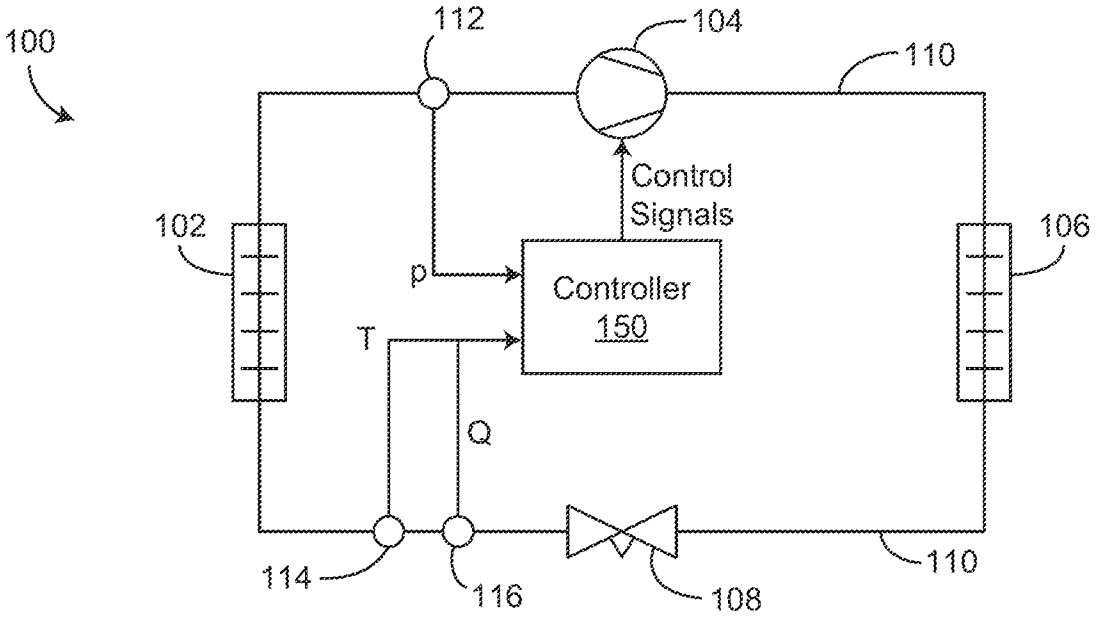
FIG. 1 is a diagram of a refrigeration system or unit for cooling a space using a refrigerant, according to some embodiments.

Referring particularly to FIG. 1, a refrigeration system 100 (e.g., a critically charged refrigeration system or unit, a refrigerator, a freezer, a refrigerated display case, a freezer room, etc.) is shown, according to some embodiments. The refrigeration system 100 may be included in an refrigeration unit, or the refrigeration unit may be a component of the refrigeration system 100, all of which are fluidly coupled with each other in a loop via piping 110 (e.g., hoses, tubular members, conduits, etc.). The refrigeration system 100 is configured to cool a space (e.g., a volume, a refrigeration zone, a freezer zone, the interior of a refrigerator, etc.). The refrigeration system 100 includes a compressor 104, a condenser 106, an expansion valve 108, and an evaporator 102. The compressor 104 is configured to pressurize a refrigerant and drive the refrigerant through piping 110 to the condenser 106. The refrigerant passes through the condenser 106, cools and releases heat, and exits the condenser 106. The refrigerant is then driven through piping 110 to the expansion valve 108. The refrigerant passes through the expansion valve 108 and expands (to thereby cool) before entering the evaporator 102. The refrigerant is then provided to the evaporator 102 to absorb heat from the space to cool the space. After the refrigerant exits the evaporator 102, the refrigerant returns to the compressor 104. In some embodiments, the condenser 106 including the indirect evaporative heat exchangers 312 is suited for dry climates and improves the COP of the refrigeration system 100 by at least one order of magnitude.

The refrigeration system 100 also includes a pressure sensor 112 positioned on a suction side of the compressor 104. The pressure sensor 112 is configured to provide measurements of pressure of the refrigerant as the refrigerant enters the compressor 104. The refrigeration system 100 also includes a temperature sensor 114 that is positioned along the piping 110 before an inlet of the evaporator 102. The temperature sensor 114 can be the temperature sensor 114. In some embodiments, the temperature sensor 114 is configured to provide a temperature of the refrigerant prior to entry of the evaporator 102 to the controller 150. In some embodiments, the refrigeration system 100 includes a flow rate sensor 116 that is configured to measure a flow rate (e.g., volumetric flow rate, velocity, mass flow rate, etc.) (e.g., downstream of the expansion valve 108) and provide the flow rate (shown as Q) to the controller 150.

It should be understood that the refrigerant may be any type of refrigerant such as R32, 410A, R22, CO2, propane, etc., and the systems and methods described herein can apply to any refrigeration system or multiple refrigeration systems that use the same or different refrigerants.

The controller 150 can be configured to generate control signals for the compressor 104 and operate the compressor 104 based on any of the temperature, pressure, or flow rates obtained from the temperature sensor 114, the pressure sensor 112, or the flow rate sensor 116. In some embodiments, the controller 150 is configured to operate the compressor 104 using a closed loop control scheme (e.g., PID control, PI control, etc.). For example, the controller 150 can be configured to perform various control algorithms.

Pressure-Enthalpy Graph

Figure 2:
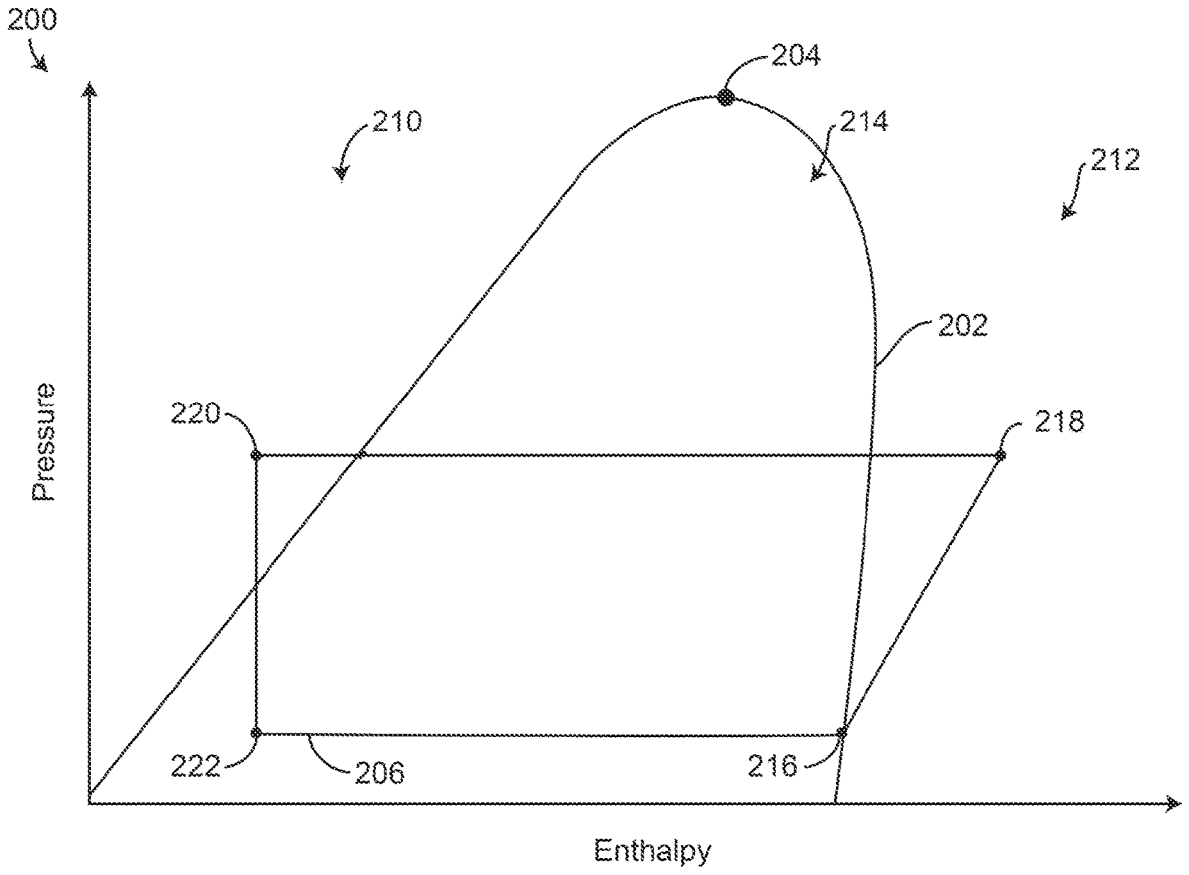
FIG. 2 is a pressure-enthalpy diagram showing the thermodynamic process of the refrigeration system or unit of FIG. 1, according to some embodiments.

Referring to FIG. 2, a pressure-enthalpy graph 200 illustrates thermodynamic changes to the refrigerant of the refrigeration system 100 as the refrigerant is circulated through the refrigeration system 100, according to some embodiments. Specifically, the pressure-enthalpy graph 200 illustrates thermodynamic changes that happen to the refrigerant when the refrigeration system 100 is fully charged (e.g., a current level or amount of refrigerant in the refrigeration system 100 is substantially equal to a critical charge amount) as illustrated by path 206.

The pressure-enthalpy graph 200 includes a vapor dome 202 that includes a critical point 204. An area within the vapor dome 202 illustrates a liquid-vapor region of the refrigerant, shown as liquid-vapor region 214. An area outside of the vapor dome 202 and to the right of the critical point 204 illustrates a superheated vapor region, shown as superheated vapor region 212. An area outside of the vapor dome 202 and to the left of the critical point 204 illustrates a subcooled region, shown as subcooled region 210. Points along the vapor dome 202 to the left of the critical point 204 are saturated liquid points. Points along the vapor dome 202 to the right of the critical point 204 are saturated vapor points.

A first point 216, which is shown on the vapor dome 202 (e.g., along a saturated vapor portion of the vapor dome 202) illustrates the thermodynamic state of the refrigerant as the refrigerant enters the compressor 104. As the refrigerant is pressurized by the compressor 104, the pressure and enthalpy of the refrigerant increases. A second point 218 of the path 206 illustrates a thermodynamic state of the refrigerant as the refrigerant exits the compressor 104 after being pressurized. As shown in FIG. 2, the second point 218 lies in the superheated vapor region with increased pressure relative to the first point 216.

When the refrigerant enters the condenser 106, the refrigerant is at or substantially at the point 218. As the refrigerant passes through the condenser 106, enthalpy of the refrigerant decreases, while pressure of the refrigerant remains substantially constant. Temperature of the refrigerant also decreases as the refrigerant passes through the condenser 106. The refrigerant transitions into a subcooled liquid state (e.g., the subcooled region 210) as the refrigerant exits the condenser 106, shown as point 220.

When the refrigerant enters the expansion valve 108, the refrigerant is at or substantially at the point 220. As the refrigerant passes through the expansion valve 108, the refrigerant expands (e.g., the pressure decreases while the enthalpy remains substantially the same), thereby causing further cooling and transitioning the refrigerant into a vapor liquid mixture, as represented by a point 222. Once the refrigerant achieves the thermodynamic state shown at point 222, the refrigerant can be used to cool the space (e.g., by being transferred through the evaporator 102).

As the refrigerant passes through the evaporator 102, the refrigerant cools the space (e.g., heat transfer from the air of the space to the refrigerant) and thereby increases in temperature. As the refrigerant increases in temperature, the refrigerant also increases in enthalpy while the pressure of the refrigerant remains substantially the same. The refrigerant increases in temperature and enthalpy until the refrigerant achieves the thermodynamic state as shown at point 216 (e.g., as the refrigerant exits the evaporator 102). The point 216 is the starting point of the process illustrated by path 206.

Condenser Unit

Figure 3:
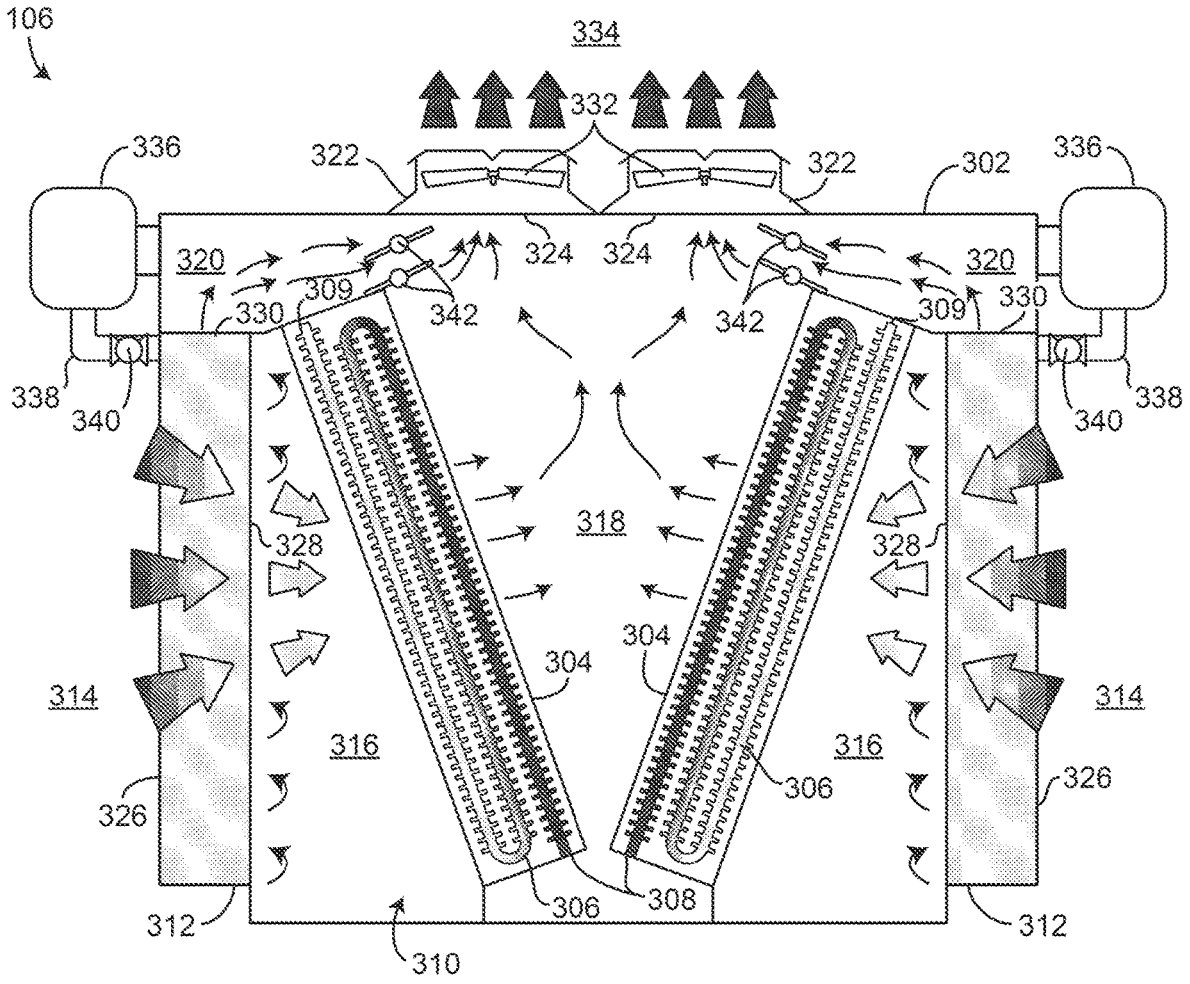
FIG. 3 is a diagram of a condenser unit of the refrigeration system of FIG. 1 including an indirect evaporative heat exchanger configured to pre-cool air in an operational mode, according to some embodiments.
Figure 4:
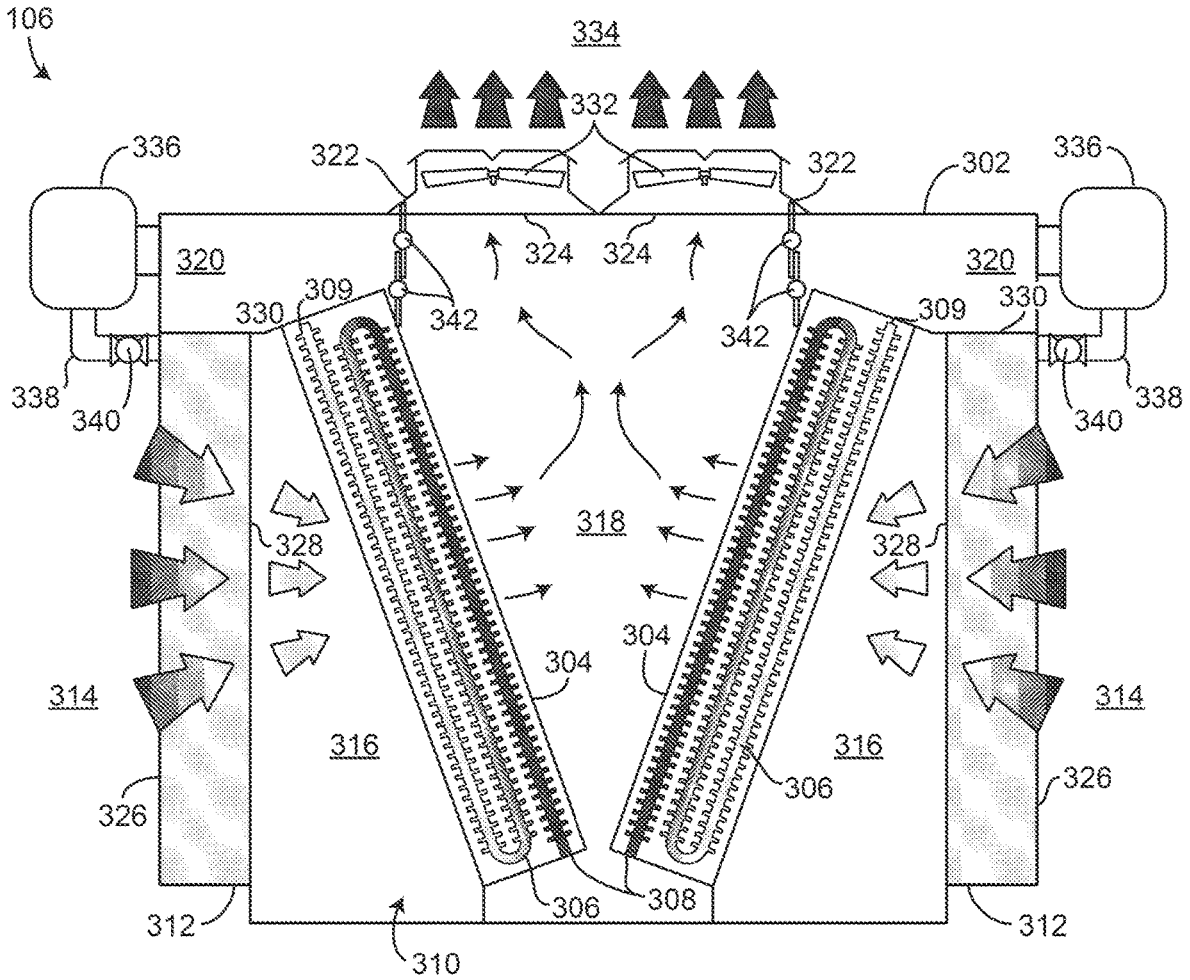
FIG. 4 is a diagram of the condenser unit of FIG. 3 with the indirect evaporative heat exchanger in a standby or inactive mode, according to some embodiments.

Referring to FIGS. 3-4, the condenser 106 may include one or more refrigeration coils 306 (e.g., condenser coils, gas coils, etc.) configured to receive warm or hot refrigerant through openings 308 (e.g., from the compressor 104), cool or condense the refrigerant as the refrigerant travels through the refrigeration coils 306, and exits the refrigeration coils 306 through outlets 309. The condenser 106 includes sidewalls or a housing 302 that define an inner volume 310 within which the refrigeration coils 306 are positioned. In some embodiments, the condenser 106 includes fans 332 that are positioned on top or on a side of the housing 302 (e.g., within canopies 322) and are configured to draw air through the condenser 106 to facilitate cooling of the refrigerant as the refrigerant travels through the coils 306. In some embodiments, the fans 332 operate such that ambient or environmental air is drawn from ambient 314, and expelled into the environment as warm air at exhaust 334 (e.g., exhaust air).

The condenser 106 can also include indirect evaporative heat exchangers 312 that are positioned along a flow path of the air between the ambient 314 and the exhaust 334. In some embodiments, the condenser 106 includes multiple evaporative heat exchangers 312 positioned downstream of inlets 326 at which the air is drawn from the ambient 314 into the condenser 106 (e.g., into the inner volume 310 of the housing 302). The evaporative heat exchangers 312 are configured to pre-cool the air in a manner such that the air remains at low humidity in order to facilitate improved cooling and condensation of the refrigerant as the refrigerant travels through the coils 306.

Referring still to FIGS. 3-4, the evaporative heat exchangers 312 are configured to receive air from the ambient 314 through the inlets 326, and discharge pre-cooled air into intermediate volumes 316 through outlets 328. The intermediate volumes 316 are a space between the outlets of the evaporative heat exchangers 312 an inlets of the refrigeration coils 306 (e.g., between the evaporative heat exchangers 312 and the refrigeration coils 306). The pre-cooled air is driven (e.g., by operation of the fans 332) to flow over or around the refrigeration coils 306 in order to condense the refrigerant that is travelling through the refrigeration coils 306. As the pre-cooled air travels over the refrigeration coils 306, the pre-cooled air absorbs heat from the refrigeration coils 306, thereby facilitating condensation and cooling of the refrigerant, and being discharged through outlets 304 into a central inner volume 318 as hot air. The hot air in the central inner volume 318 is driven (e.g., by operation of the fans 332) to be discharged from the inner volume 318 of the condenser 106 through vents 324 that are proximate the fans 332 as exhaust air.

Referring still to FIGS. 3-4, the condenser 106 also includes or defines exhaust spaces 320 proximate secondary outlets 330 of the indirect evaporative heat exchanger 312. In some embodiments, the spaces 320 are fluidly separate from the intermediate volumes 316 and the central inner volume 318. The spaces 320 are defined between the secondary outlets 330 of the indirect evaporative heat exchangers 312, one or more adjustable louvres 342 (e.g., vents, fans, etc.), and the housing 302. In some embodiments, the spaces 320 are configured to receive moist exhaust air from the indirect evaporative heat exchangers 312. The moist exhaust air may be driven to pass the louvres 342 and mix with the hot air in the central inner volume 318 before being expelled to the exhaust 334 through the vents 324. In some embodiments, the transfer of the moist exhaust air is driven by operation of the fans 332 and position of the louvres 342. For example, when the louvres 342 are in an open position as shown in FIG. 3, the airflow from the secondary outlets 330 through the spaces 320 is produced due to operation of the fans 332. The airflow as shown in FIG. 3 results in the indirect evaporative heat exchanger 312 functioning to provide cooling for the air passing through the indirect evaporative heat exchanger 312 such that the air is pre-cooled before entering the intermediate volumes 316. In some embodiments, the airflow through the spaces 320 also drives a recirculation of air from the outlets 328 back through wetted or secondary channels of the indirect evaporative heat exchanger 312. The air may recirculate at the intermediate volumes 316 and is used to cool air that is currently travelling through the indirect evaporative heat exchanger 312 from the ambient 314 to the intermediate inner volume 316. In this way, air travels through the indirect evaporative heat exchanger 312 from the ambient 314 to the intermediate volume 316, a portion of which is provided to the refrigeration coils 306, and a portion of which is recirculated through secondary channels of the indirect evaporative heat exchanger 312 and is discharged into the spaces 320 (e.g., for exhaust to the exhaust 334).

Referring to FIG. 4, the louvres 342 may be transitioned into a closed position to thereby cease the airflow through the space 320, and also cease the recirculation of air through the indirect evaporative heat exchanger 312. In some embodiments, the louvres 342 are configured to control an amount of air that is recirculated back through the indirect evaporative heat exchanger 312. For example, when the louvres 342 are adjusted into the closed position as shown in FIG. 4, the recirculation of air through the indirect evaporative heat exchanger 312 is substantially zero and all of the air that enters the indirect evaporative heat exchanger 312 is passed through the indirect evaporative heat exchanger 312 into the intermediate volume 316.

Referring to FIGS. 3-4, the condenser 106 can include a water tank 336 (e.g., a reservoir, a container, a receptacle, etc.) that is configured to provide water through a pipe 338 (e.g., a tubular member, a conduit, a line, a hose, etc.) and a valve 340. The valve 340 may control flow of the water (e.g., a fluid) to an interior of the indirect evaporative heat exchanger 312 through the pipe 338. In some embodiments, the water tank 336 is configured to provide water or moisture to one or more wetted passageways of the indirect evaporative heat exchanger 312 to facilitate indirect evaporation and cooling of the air that passes through the indirect evaporative heat exchanger 312 before being transferred to the refrigeration coils 306.

Indirect Evaporative Heat Exchanger

Figure 9:
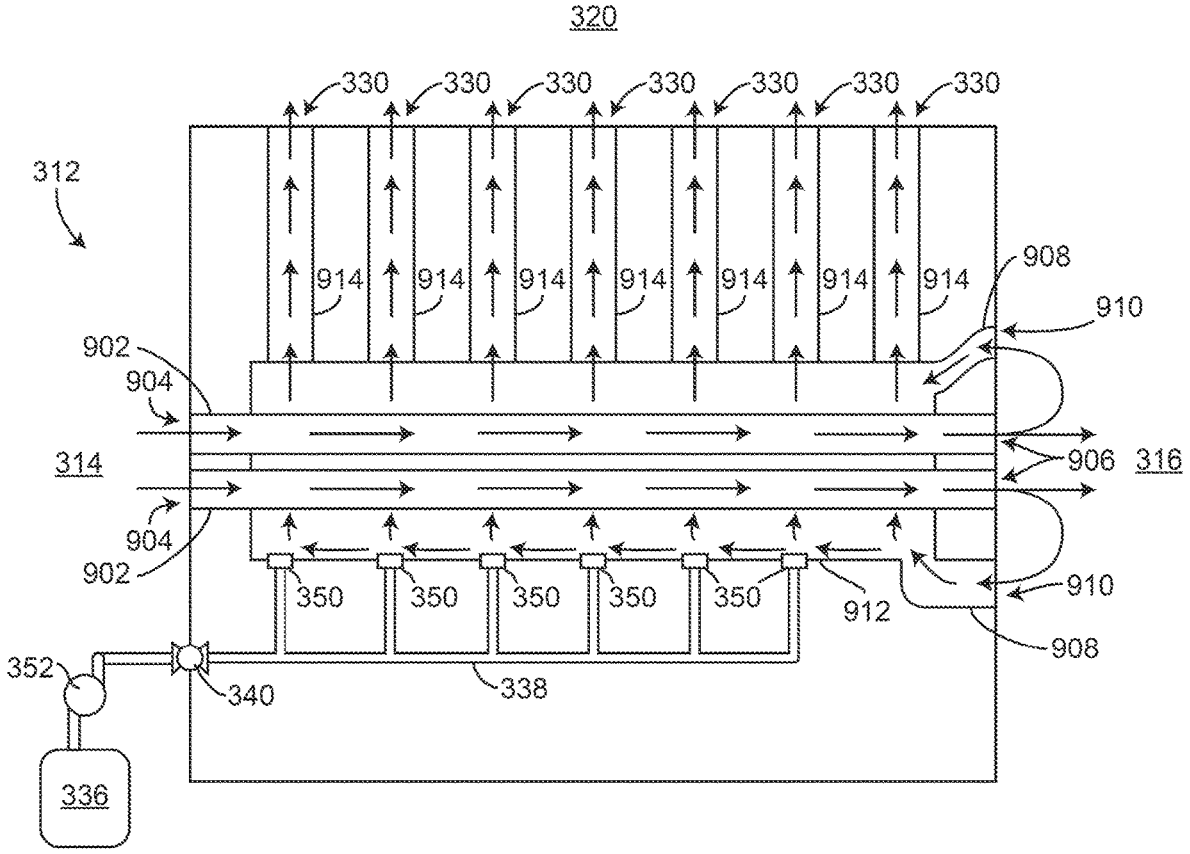
FIG. 9 is a diagram illustrating the indirect evaporative heat exchanger of FIGS. 3-4 in greater detail, according to some embodiments.

Referring to FIG. 9, the indirect evaporative heat exchanger 312 is shown in greater detail, according to some embodiments. The indirect evaporative heat exchanger 312 includes multiple dry passages 902, and multiple wet passages that are defined by wet inlet passages 908, wet medial passages 912, and wet outlet passages 914. In some embodiments, the wet inlet passages 908, the wet medial passages 912, and the wet outlet passages 914 are volumes, channels, grooves, apertures, bores, openings, perforations, spaces, etc., in a body material of the indirect evaporative heat exchanger 312. In some embodiments, the wet passages include multiple wet inlet passages 908. In some embodiments, the wet passages include multiple outlet passages 908. In some embodiments, the wet inlet passages 908, the wet medial passages 912, and the wet outlet passages 914 are different portions of a continuous passage that defines a flow path between the intermediate volumes 316 and the exhaust spaces 320 through the indirect evaporative heat exchanger 312. In some embodiments, the dry passages 902 include inlets or openings 904 that define an access point into the inner volume of the dry passages 902 by air from the ambient 314. In this way, air from the ambient 314 may enter the dry passages 902 through the openings 904 (multiple of which or an aggregate of which define the inlets 326 of the indirect evaporative heat exchanger 312), flow through the dry passages 902, undergo evaporative cooling, and exit the passages 902 into the intermediate volumes 316 through outlets 906. In some embodiments, the dry passages 902, the openings 904 (e.g., inlets), and the outlets 906 define multiple fluid flow paths to fluidly couple the ambient 314 with the intermediate volumes 316 through the dry passages such that air can be drawn from the ambient 314, through the dry passages 902, and into the intermediate volumes 316 while undergoing pre-cooling during travel through the dry passages 902.

In some embodiments, a portion of the air that exits the passages 902 is recirculated into the wet passages through inlets 910 (e.g., openings, holes, windows, apertures, etc.) of the wet inlet passages 908. The recirculated air may be drawn back through the wet inlet passages 908 due to operation of the fans 332 and the louvres 342 being in the opened position. In some embodiments, the position or the degree of openness of the louvres 342 (e.g., a cross-sectional flow area defined by the louvres 342) and/or a speed of the fans 332 results in different proportions of the air that exits the dry passages 902 being drawn back into the wet outlet passages 914. For example, when the louvres 342 are in the closed position, none of the air that exits the dry passages 902 into the intermediate volumes 316 is recirculated into the wet outlet passages 914. Similarly, when the louvres 342 are fully opened, a highest amount or rate of air is recirculated through the wet inlet passages 908.

In some embodiments, the dry passages 902 are fluidly separate from the wet passages (e.g., the wet inlet passages 908, the wet medial passages 912, and the wet outlet passages 914). In some embodiments, the water tank 336 is configured to provide liquid or moisture (e.g., droplets, a spray of water, a spray of mist, etc.) to the wet medial passages 912 through pipes 338 and discharge devices 350 (e.g., openings, inlets, misters, etc.). In some embodiments, the moisture provided by the water tank 336 coats or forms droplets on the exterior of an exterior or outer surface of the dry passages 902 such that the air passing through the dry passages 902 undergoes indirect evaporative cooling. The air that is recirculated through the wet inlet passages 908, the wet medial passages 912, and the wet outlet passages 914 may absorb moisture, and provide an airflow over the dry passages 902 (or sidewalls of the dry passages 902) to thereby provide cooling of the air that passes through the dry passages 902. In some embodiments, the tank 336 is configured to discharge the water or moisture into the wet passages by operation of a pump 352 and opening of the valve 340.

Control System

Figure 7:
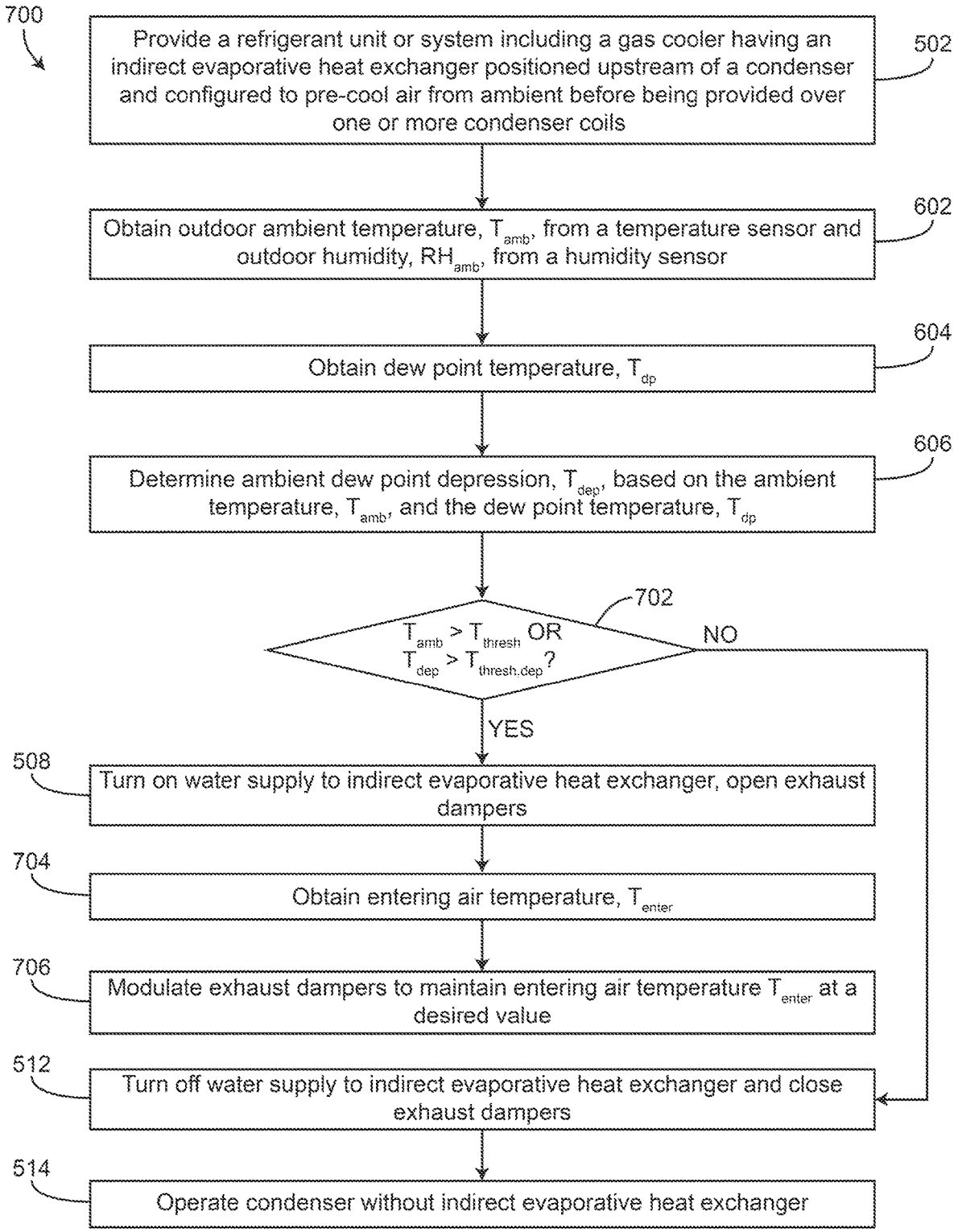
FIG. 7 is a flow diagram of yet another process for condensing a refrigerant using an indirect evaporative heat exchanger, according to some embodiments.
Figure 8:
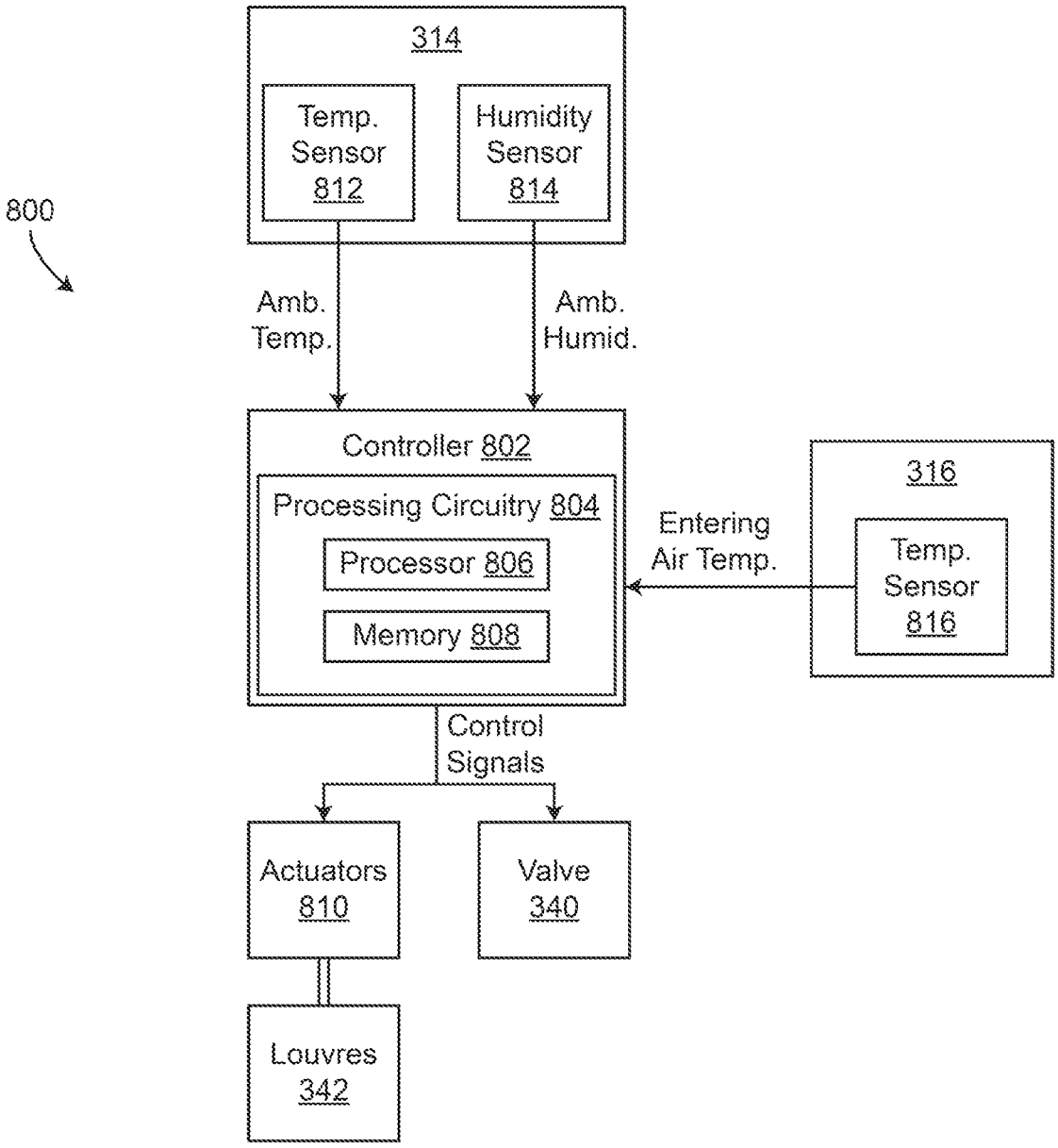
FIG. 8 is a block diagram of a control system for controlling the indirect evaporative heat exchanger of FIGS. 3-4, according to some embodiments.

Referring to FIG. 8, a control system 800 for the indirect evaporative heat exchangers 312 includes a controller 802 that is configured to generate control signals for actuators 810 (e.g., electric motors, stepper motors, rotary motors, linear electric actuators, etc.) and the valve 340 of the water tank 336 in order to provide a desired or optimal amount of pre-cooling to the air from the ambient 314 before the air is provided to the refrigeration coils 306. In some embodiments, the controller 802 is configured to receive an ambient temperature reading from a temperature sensor 812 that is positioned in the ambient 314 and a humidity reading from a humidity sensor 814 that is positioned in the ambient 314. The controller 802 is also configured to receive an entering air temperature reading from a temperature sensor 816 (e.g., a thermistor) that is positioned in the intermediate volumes 316. The entering air temperature reading may indicate a temperature of air as the air enters an area or space of the refrigeration coils 306. In some embodiments, the controller 802 is configured to control the positions of the louvres 342 by controlling the actuators 810 such that the entering air temperature reading is at a desired level or within a desired range. In some embodiments, the controller 802 is the controller 150 such that any functionality of the controller 802 as described herein with reference to FIG. 8 or FIGS. 5-7 may be performed by the controller 150. In some embodiments, the controller 802 is also configured to control the fans 332 (e.g., by operating a corresponding electric motor) such that a required airflow is drawn over the refrigeration coils 306 in order to achieve a desired cooling or condensation of the refrigerant to meet the required cooling demand of the refrigeration system 100.

Referring still to FIG. 8, the controller 802 includes processing circuitry 804 including a processor 806 and memory 808. Processor 806 can be a general purpose or specific purpose processor, an application specific integrated circuit (ASIC), one or more field programmable gate arrays (FPGAs), a group of processing components, or other suitable processing components. Processor 806 can be configured to execute computer code and/or instructions stored in memory 808 or received from other computer readable media (e.g., CDROM, network storage, a remote server, etc.).

Memory 808 can include one or more devices (e.g., memory units, memory devices, storage devices, etc.) for storing data and/or computer code for completing and/or facilitating the various processes described in the present disclosure. Memory 808 can include random access memory (RAM), read-only memory (ROM), hard drive storage, temporary storage, non-volatile memory, flash memory, optical memory, or any other suitable memory for storing software objects and/or computer instructions. Memory 808 can include database components, object code components, script components, or any other type of information structure for supporting the various activities and information structures described in the present disclosure. Memory 808 can be communicably connected to processor 806 via processing circuitry 804 and can include computer code for executing (e.g., by processor 806) one or more processes described herein.

The controller 802 is configured to receive the ambient temperature reading, the ambient humidity reading, and the entering air temperature reading and perform a control process to generate the control signals for the actuators 810 (e.g., to control position of the louvres 342 and to turn on or turn off the water supply from the water tank 336 by actuating the valve 340). In some embodiments, the valve 340 is a pneumatic or electrically operable valve that can be controlled to transition between an open position and a closed position. In some embodiments, the controller 802 is configured to compare the ambient temperature reading (e.g., $T_{amb}$) to a threshold temperature (e.g., $T_{thresh}$) (e.g., 80 degrees Fahrenheit) and, in response to the ambient temperature reading exceeding the threshold temperature (e.g., $T_{amb}>T_{thresh}$), determining that the louvres 342 should be transitioned into a fully open position and turning on the water supply from the water tank 336 so that the wet inlet passages 908, the wet medial passages 912, and the wet outlet passages 914 are provided with water or moisture to facilitate evaporative cooling of the air that passes through the dry passages 902.

Referring still to FIG. 8, the controller 802 can also be configured to calculate an ambient dewpoint depression $T_{dep}$ based on the ambient temperature reading $T_{amb}$ and the ambient humidity (e.g., $RH_{amb}$). In some embodiments, the controller 802 is configured to calculate a dewpoint temperature $T_{dewpoint}$ based on the ambient temperature reading and the ambient humidity. In some embodiments, the ambient dewpoint depression $T_{dep}$ is calculated as a difference between the ambient temperature reading $T_{amb}$ and the dewpoint temperature $T_{dewpoint}$. In some embodiments, the controller 802 is configured to compare the ambient dewpoint depression $T_{dep}$ to a threshold $T_{thresh,dep}$ (e.g., 10 degrees Fahrenheit), and, in response to the ambient dewpoint depression $T_{dep}$ exceeding the threshold $T_{thresh,dep}$, the controller 802 may control the louvres 342 to be opened (e.g., 100% open) and that the valve 340 should be opened so that the water tank 336 provides water or moisture to the wet passages of the indirect evaporative heat exchanger 312.

Referring still to FIG. 8, the controller 802 may be configured to use both (i) the comparison between the ambient temperature reading $T_{amb}$ and the threshold temperature $T_{thresh}$, and (ii) the comparison between the ambient dewpoint depression $T_{dep}$ and the threshold dewpoint $T_{thresh,\ dep}$. If either (a) the ambient temperature reading $T_{amb}$ exceeds the threshold temperature $T_{thresh}$, or (b) the ambient dew point depression $T_{dep}$ exceeds the threshold dewpoint $T_{thresh,dep}$, the controller 802 may operate the actuators 810 to open the louvres 342 and operate the valve 340 to provide water from the water tank 336 to the wet passages.

Referring still to FIG. 8, the controller 802 may be configured to control operation of the actuators 810 to adjust the louvres 342 between a fully open (e.g., 100% open) and a fully closed position (e.g., 0% open) or any position in between (e.g., 50% open, 30% open, etc.). In some embodiments, the controller 802 is configured to control the position of the louvres 342 based on the entering air temperature provided by the temperature sensor 816 such that the entering air temperature is greater than the dewpoint temperature $T_{dewpoint}$ by a threshold amount (e.g., 2 degrees Fahrenheit). In some embodiments, the controller 802 is configured to perform a closed loop control scheme by controlling the actuators 810 (e.g., the positions of the louvres 342) such that the entering air temperature is greater than the dew point temperature by a threshold amount (e.g., 2 degrees Fahrenheit).

Control Processes

Figure 5:
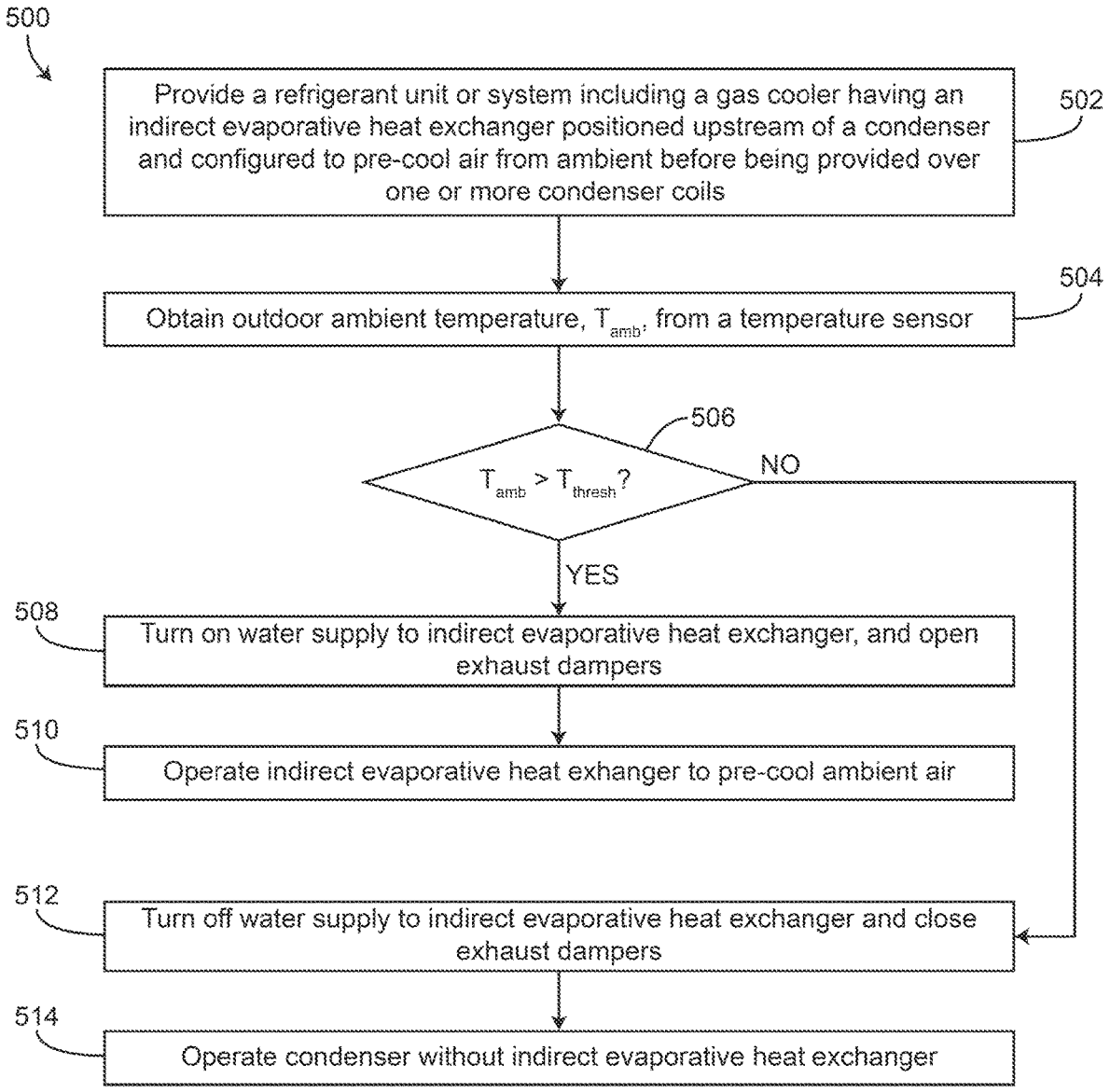
FIG. 5 is a flow diagram of a process for condensing a refrigerant using an indirect evaporative heat exchanger, according to some embodiments.

Referring particularly to FIG. 5, a flow diagram of a process 500 for cooling a refrigerant using an indirect evaporative heat exchanger includes steps 502-514, according to some embodiments. In some embodiments, the process 500 (or portions thereof) can be performed by the controller 802 in order to turn on or turn off the indirect evaporative heat exchanger to pre-cool air before the air is provided over a refrigeration coil.

The process 500 includes providing a refrigerant unit or system including a gas cooler having an indirect evaporative heat exchanger positioned upstream of a condenser and configured to pre-cool air from an ambient environment before being provided over one or more condenser coils (step 502), according to some embodiments. In some embodiments, step 502 includes providing the refrigeration system 100 as a packaged unit, including the condenser 106 as shown and described in greater detail above with reference to FIGS. 3 and 4. In some embodiments, the indirect evaporative heat exchanger is the indirect evaporative heat exchanger 312.

The process 500 includes obtaining an outdoor ambient temperature, $T_{amb}$, from a temperature sensor (step 504), according to some embodiments. In some embodiments, step 504 include obtaining a temperature reading from a temperature sensor (e.g., the temperature sensor 812) positioned in the ambient 314. In some embodiments, the ambient 314 is an outdoor environment (e.g., exterior to the unit or the condenser 106) from which fresh air is drawn.

The process 500 also includes comparing the outdoor ambient temperature, $T_{amb}$, to a threshold amount, $T_{thresh}$ (step 506), according to some embodiments. In some embodiments, in response to the outdoor ambient temperature, $T_{amb}$, exceeding the threshold amount $T_{thresh}$ (e.g., $T_{amb}>T_{thresh}$), process 500 proceeds to step 508. In some embodiments, in response to the outdoor ambient temperature, $T_{amb}$, being less than (or less than or equal to) the threshold amount $T_{thresh}$ (e.g., $T_{amb}<T_{thresh}$), process 500 proceeds to step 512. In some embodiments, steps 504 and 506 are performed by the controller 802.

The process 500 includes turning on a water supply to the indirect evaporative heat exchanger and opening exhaust dampers (step 508), according to some embodiments. In some embodiments, step 508 is performed by the controller 802 by generating control signals for a valve of the water supply (e.g., the valve 340 or a pump of the water tank 336) and control signals for an electric motor or actuator of a louvre (e.g., the actuators 810 of the louvres 342). In some embodiments, step 508 includes controlling the water supply to an on position such that one or more wet passages are provided with water or moisture, and controlling the dampers or louvres so that the dampers or louvres are at a fully opened position. In some embodiments, opening the exhaust dampers (e.g., the louvres 342) results in re-circulatory airflow of air exiting the indirect evaporative heat exchangers such that a portion of air exiting the indirect evaporative heat exchangers through one or more dry passages is re-introduced to the indirect evaporative heat exchangers through one or more wet passages to thereby cause indirect evaporative cooling of the air travelling through the dry passages.

The process 500 includes operating the indirect evaporative heat exchanger to pre-cool the ambient air (step 510), according to some embodiments. In some embodiments, step 510 includes continuing to operate exhaust fans of the condenser 106 (e.g., the fans 332) with the louvres 342 being continually held in the fully open position. In some embodiments, step 510 also includes operating the refrigeration system 100 (e.g., by operating the compressor 104 to drive the refrigerant through the piping).

The process 500 includes turning off the water supply to the indirect evaporative heat exchanger and closing the exhaust dampers (step 512), according to some embodiments. In some embodiments, step 512 is performed similarly to step 508, but to close the valve for the water supply, and to transition the exhaust dampers (e.g., the louvres 342) into the fully closed position. When the exhaust dampers are in the fully closed position and the valve of the water supply is shut (e.g., turned off), the airflow through the indirect evaporative heat exchanger occurs without pre-cooling of the air that travels through the dry passages.

The process 500 includes operating the condenser without indirect evaporative heat exchanger (step 514), according to some embodiments. In some embodiments, step 514 includes operating the compressor 104 to discharge the refrigerant through the piping 110. In some embodiments, operating the condenser without the indirect evaporative heat exchanger being active results in the condenser using the outdoor air for cooling the refrigeration coils.

Figure 6:
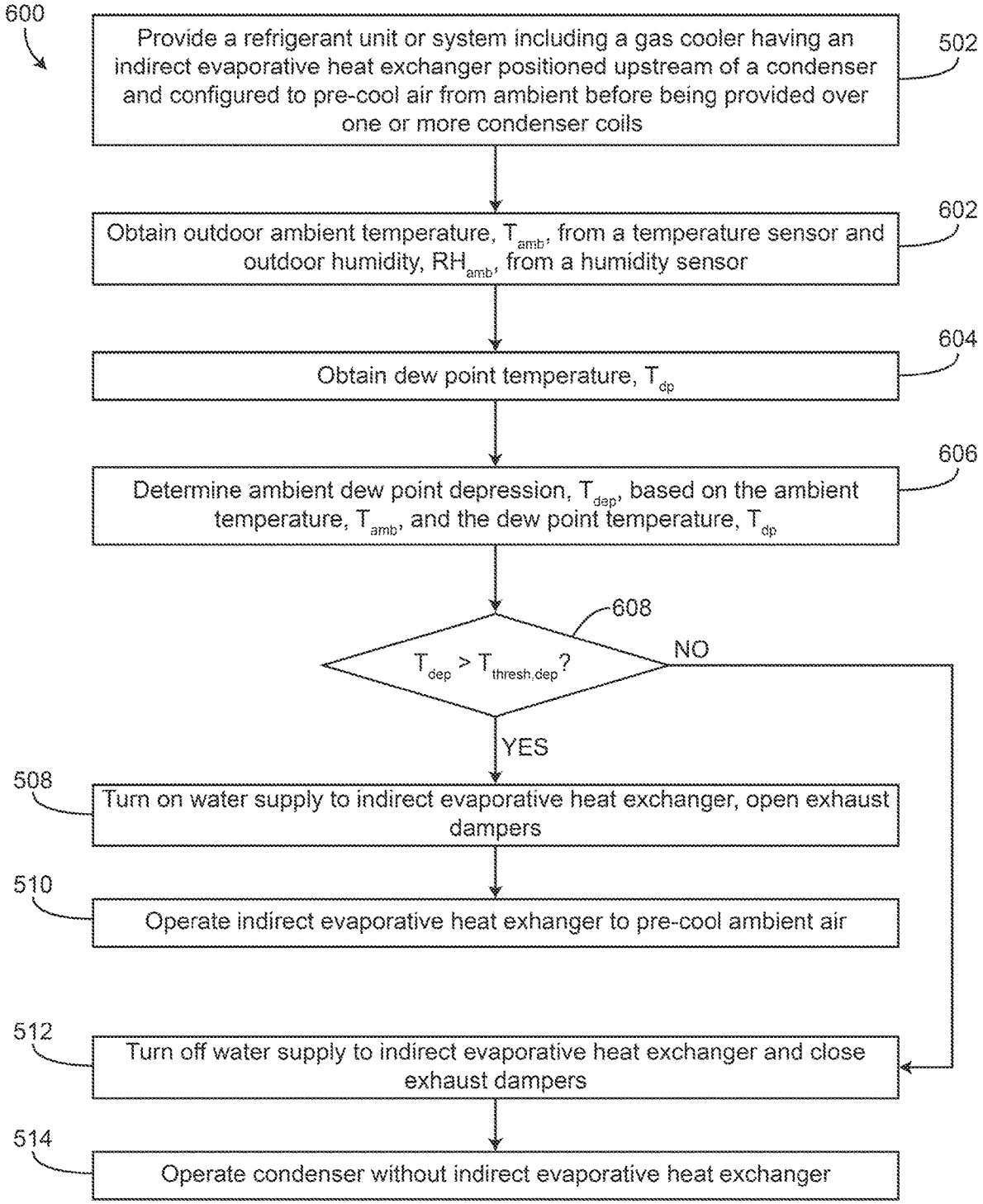
FIG. 6 is a flow diagram of another process for condensing a refrigerant using an indirect evaporative heat exchanger, according to some embodiments.

Referring to FIG. 6, a flow diagram of a process 600 for cooling a refrigerant using an indirect evaporative heat exchanger includes steps 502, 602-608, and 508-514, according to some embodiments. In some embodiments, the process 600 (or portions thereof) can be performed by the controller 802 in order to turn on or turn off the indirect evaporative heat exchanger to pre-cool air before the air is provided over a refrigeration coil.

The process 600 includes the step 502 of process 500 (e.g., providing the condenser 106 including the indirect evaporative heat exchanger 312) and also includes obtaining outdoor ambient temperature, $T_{amb}$, from a temperature sensor and obtaining outdoor humidity (e.g., relative humidity) $RH_{amb}$, from a humidity sensor (step 602), according to some embodiments. In some embodiments, step 602 is similar to step 504 of process 500, but also includes obtaining the outdoor humidity $RH_{amb}$ from the humidity sensor. In some embodiments, the humidity sensor is positioned proximate the temperature sensor. For example, the humidity sensor may be positioned in the ambient 314. In some embodiments, step 602 is performed by the controller 802.

The process 600 includes obtaining a dew point temperature, $T_{dp}$ (step 604), according to some embodiments. In some embodiments, step 604 the dew point temperature $T_{dp}$ is calculated based on the outdoor ambient temperature $T_{amb}$ and the outdoor humidity $RH_{amb}$ by the controller 802. In some embodiments, the dew point temperature $T_{dp}$ is determined based on the outdoor ambient temperature $T_{amb}$ and the outdoor humidity $RH_{amb}$ using a look up table, a regression model, a function, an equation, a graph or chart, etc. The dew point temperature indicates a temperature that air in the ambient (e.g., outside of the condenser 106) should be cooled to (e.g., at a constant pressure) in order to achieve $RH_{amb}$=100%.

The process 600 includes determining an ambient dew point depression, $T_{dep}$, based on the ambient temperature $T_{amb}$ and the dew point temperature $T_{dp}$ (step 606), according to some embodiments. In some embodiments, step 606 is performed by the controller 802. In some embodiments, step 606 includes determining a difference between the ambient temperature $T_{amb}$ and the dew point temperature $T_{dp}$ (e.g., $T_{dep}=T_{amb}-T_{dp}$).

The process 600 includes determining if the ambient dew point depression $T_{dep}$ is greater than a threshold amount, $T_{thresh,dep}$ (step 608), according to some embodiments. In some embodiments, step 608 is performed by the controller 802. Step 608 may include comparing the ambient dew point depression $T_{dep}$ to the threshold amount $T_{thresh,dep}$ and, in response to the ambient dew point depression $T_{dep}$ being greater than the threshold amount $T_{thresh,\ dep}$ (step 608, "YES"), process 600 proceeds to step 508. In response to the ambient dew point depression $T_{dep}$ being less than the threshold amount $T_{thresh,\ dep}$ (step 608, "NO"), process 600 proceeds to step 512. In some embodiments, the threshold amount $T_{thresh,dep}$ is a fixed amount such as 10 degrees Fahrenheit. In some embodiments, the threshold amount $T_{thresh,dep}$ is an adjustable amount that can be set by the user (e.g., by providing a user input to the controller 802), or is adjusted given a selected mode of operation.

The process 600 includes steps 508-810 which are performed responsive to the ambient dew point depression $T_{dep}$ being greater than the threshold amount $T_{thresh,\ dep}$ (step 608, "YES"), and steps 512-514 which are performed responsive to the ambient dew point depression $T_{dep}$ being less than the threshold amount $T_{thresh,\ dep}$ (step 608, "NO"). In some embodiments, steps 508 and 510 are performed continuously until the condition $T_{dep}>T_{thresh,dep}$ is no longer met. Similarly, steps 512 and 514 can be performed continuously until the condition $T_{dep}\geq T_{thresh,dep}$ is no longer met.

Referring to FIG. 7, a flow diagram of a process 700 for cooling a refrigerant using an indirect evaporative heat exchanger includes steps 502, 602-606, 702, 508, 704-706, and 512-514, according to some embodiments. In some embodiments, the process 700 (or portions thereof) can be performed by the controller 802 in order to turn on or turn off the indirect evaporative heat exchanger to pre-cool air before the air is provided over a refrigeration coil, and to adjust operation of the indirect evaporative heat exchanger to maintain a desired level or amount of pre-cooling for the air before the air is provided over the refrigeration coil.

The process 700 includes step 502 of process 500, and steps 602-606 of process 600. In some embodiments, the process 700 includes performing the step 502 of process 500, and steps 602-606 of process 600. The process 700 also includes determining if either (a) the ambient temperature exceeds a threshold ($T_{amb}>T_{thresh}$) or (b) the ambient dew point depression $T_{dep}$ is greater than a threshold amount $T_{thresh,dep}$ ($T_{dep}>T_{thresh,dep}$) (step 702), according to some embodiments. If either (a) $T_{amb}>T_{thresh}$ or (b) $T_{dep}>T_{thresh,dep}$, process 700 proceeds to step 508. If both (i) $T_{amb}\leq T_{thresh}$ and (ii) $T_{dep}\leq T_{thresh,dep}$, process 700 proceeds to step 512.

The process 700 includes performing step 508 (e.g., turning on water supply to the indirect evaporative heat exchanger, etc.) and obtaining entering air temperature $T_{enter}$ (step 704) in response to either (a) $T_{amb}>T_{thresh}$ or (b) $T_{dep}>T_{thresh,dep}$ (step 702, "YES"), according to some embodiments. In some embodiments, step 704 includes obtaining a temperature reading from a sensor that is positioned at an outlet of the indirect evaporative heat exchanger 312, within a space between the outlet of the indirect evaporative heat exchanger 312 and the refrigeration coils 306, or at the refrigeration coils 306. In some embodiments, the entering air temperature $T_{enter}$ is obtained from the temperature sensor 816 that is positioned within the intermediate volume 316.

The process 700 includes modulating the exhaust dampers to maintain the entering air temperature $T_{enter}$ at a desired value (step 706), according to some embodiments. In some embodiments, step 706 is performed by the controller 802 using a closed loop control scheme. For example, the controller 802 may adjust operation of the actuators 810 to adjust positions of the louvres 342 between 0% open (e.g., closed) to 100% open. In some embodiments, the desired value of the entering air temperature $T_{enter}$ indicates an amount of cooling required for the air entering the indirect evaporative heat exchanger 312. In some embodiments, the desired value of the entering air temperature $T_{enter}$ is the dew point temperature $T_{dp}$ plus a threshold amount (e.g., $T_{dp}$+2° F.). In some embodiments, the controller 802 is configured to adjust the control of the actuators 810 to thereby adjust the position of the louvres 342. Adjusting the position of the louvres 342 adjusts or changes an amount of recirculatory air through the wet passages of the indirect evaporative heat exchanger 312 (e.g., the wet inlet passages 908, the wet medial passages 912, and the wet outlet passages 914), which in turn adjusts an amount of cooling provided to the air that travels through the dry passages 902 of the indirect evaporative heat exchanger 312. In some embodiments, step 706 includes obtaining a power drawn by the compressor 104, or a total power consumption of the refrigeration system 100, and determining a target entering air temperature that is predicted to achieve or result in a desired COP of the refrigeration system 100.

Configuration of Exemplary Embodiments

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A refrigeration system comprising:

a condenser unit configured to receive warm refrigerant, condense and cool the warm refrigerant, and provide cooled refrigerant as an output, the condenser unit comprising:

a condensing coil configured to receive the warm refrigerant and output the cooled refrigerant as the output;

an indirect evaporative heat exchanger configured to receive air from ambient, and discharge cooled air to the condensing coil, the indirect evaporative heat exchanger comprising a plurality of dry channels configured to deliver outlet air to an intermediate volume, and a plurality of secondary channels configured to recirculate a portion of the outlet air and discharge exhaust air into an exhaust space;

a fan positioned above a vent, the fan configured to draw an airflow of the portion of the outlet air through the intermediate volume, across the condensing coil, into a central inner volume, and out of the condenser unit as condenser exhaust air;

a plurality of louvres adjustable between an at least partially open position and a closed position, the plurality of louvres defining a boundary between the exhaust space and the central inner volume; and a controller configured to operate the plurality of louvres to transition between the at least partially open position and the closed position based on a temperature reading of the ambient, and configured to modulate the plurality of louvres between the at least partially open position and a fully open position to control cooling of the refrigerant that passes through the condensing coil.

2. The refrigeration system of claim 1, wherein when the plurality of louvres are in the at least partially open position, the fan draws the exhaust air from the exhaust space, between the plurality of louvres, and discharges the exhaust air as a portion of the condenser exhaust air out of the condenser unit, wherein operation of the fan is configured to drive the recirculation of the portion of the outlet air through the plurality of secondary channels and into the exhaust space to induce indirect evaporative cooling of the air received from the ambient that travels through the plurality of dry channels.

3. The refrigeration system of claim 1, wherein the plurality of louvres are infinitely variable between the fully open position and the closed position.

4. The refrigeration system of claim 1, wherein the controller is configured to:

compare the temperature reading of the ambient to a threshold temperature;

responsive to the temperature reading of the ambient exceeding the threshold temperature:

operating a water tank to provide moisture to the plurality of secondary channels; and operating an actuator to transition the plurality of louvres into the fully open position;

responsive to the temperature reading of the ambient being less than the threshold temperature:

operating the water tank to stop providing the moisture to the plurality of secondary channels; and operating the actuator to transition the plurality of louvres into the closed position.

5. The refrigeration system of claim 1, wherein the controller is configured to:

obtain a humidity of the ambient;

determine a dew point temperature of the ambient based on the temperature reading and the humidity of the ambient;

determine an ambient dew point depression based on a difference between the dew point temperature and the temperature reading of the ambient;

compare the ambient dew point depression to a threshold dew point depression;

responsive to the ambient dew point depression exceeding the threshold dew point depression:

operating a water tank to provide moisture to the plurality of secondary channels; and operating an actuator to transition the plurality of louvres into the fully open position;

responsive to the ambient dew point depression being less than the threshold dew point depression:

operating the water tank to stop providing the moisture to the plurality of secondary channels; and operating the actuator to transition the plurality of louvres into the closed position.

6. The refrigeration system of claim 1, wherein the controller is configured to:

obtain a humidity of the ambient;

determine a dew point temperature of the ambient based on the temperature reading and the humidity of the ambient;

determine an ambient dew point depression based on a difference between the dew point temperature and the temperature reading of the ambient;

compare the ambient dew point depression to a threshold dew point depression;

compare the temperature reading of the ambient to a threshold temperature;

responsive to either (i) the ambient dew point depression exceeding the threshold dew point depression or (ii) the temperature reading of the ambient exceeding the threshold temperature:

operating a water tank to provide moisture to the plurality of secondary channels; and operating an actuator to adjust the plurality of louvres between the fully open position and the at least partially open position;

responsive to both (i) the ambient dew point depression being less than the threshold dew point depression and (ii) the temperature reading of the ambient being less than the threshold temperature:

operating the water tank to stop providing the moisture to the plurality of secondary channels; and operating the actuator to transition the plurality of louvres into the closed position.

7. The refrigeration system of claim 6, wherein operating the actuator to adjust the plurality of louvres between the fully open position and the at least partially open position comprises:

obtaining an entering air temperature of the outlet air in the intermediate volume prior to the outlet air being provided to the condensing coil;

modulating the actuator to continuously adjust a position of the plurality of louvres between the fully open position and the at least partially open position to maintain the entering air temperature at a desired temperature value to control the cooling of the refrigerant that passes through the condensing coil.

8. The refrigeration system of claim 7, wherein the desired temperature value is a sum of the dew point temperature and an offset temperature amount.

9. A control system for a condenser, the control system comprising:

an actuator configured to adjust a position of a louvre, the louvre continuously adjustable between a fully closed position and a fully open position to adjust an amount of airflow that passes through a plurality of first channels and is recirculated back through a plurality of second channels of an indirect evaporative heat exchanger, the indirect evaporative heat exchanger positioned along a flow path between an external area and a cooling coil of the condenser, the indirect evaporative heat exchanger configured to discharge a first airflow of cooled air to the cooling coil, and a second airflow of exhaust air to the louvre; and processing circuitry configured to:

obtain a temperature of air in the external area;

responsive to the temperature of the air in the external area being greater than a threshold temperature:

operating a water tank to provide moisture to a plurality of second channels of the indirect evaporative heat exchanger; and operating the actuator to transition the louvre into the fully open position.

10. The control system of claim 9, wherein the processing circuitry is configured to, in response to the temperature of the external area being less than the threshold temperature:

operate the water tank to stop providing the moisture to the plurality of second channels; and operate the actuator to transition the louvre into the fully closed position.

11. The control system of claim 9, wherein the processing circuitry is configured to:

obtain a relative humidity of the air in the external area;

obtain a dew point temperature of the air in the external area based on the relative humidity and the temperature of the air in the external area;

determine an ambient dew point depression based on the temperature of the air in the external area and the dew point temperature; and responsive to the ambient dew point depression exceeding a threshold dew point depression:

operating the water tank to provide the moisture to the plurality of second channels of the indirect evaporative heat exchanger; and operating the actuator to transition the louvre into the fully open position.

12. The control system of claim 11, wherein the processing circuitry is configured to operate the water tank to provide the moisture to the plurality of second channels of the indirect evaporative heat exchanger, and operate the actuator to transition the louvre into the fully open position in response to either (a) the temperature of the air in the external area being greater than the threshold temperature, or (b) the ambient dew point depression exceeding the threshold dew point depression.

13. The control system of claim 9, wherein the processing circuitry is further configured to:

obtain a temperature of the first airflow before the first airflow is provided to the cooling coil;

modulate operation of the actuator to continuously adjust the louvre between different open positions to maintain the temperature of the first airflow at a desired temperature.

14. The control system of claim 13, wherein the desired temperature is a temperature that achieves a desired coefficient of performance of a refrigeration system of the condenser.

15. The control system of claim 13, wherein the desired temperature comprises a dew point temperature of the air in the external area offset by a predetermined amount such that the first airflow is maintained above the dew point temperature by the predetermined amount.

16. A method for controlling a condenser unit that includes an indirect evaporative heat exchanger for pre-cooling air from ambient before the air is provided to a condenser coil, the method comprising:

responsive to a determination that the indirect evaporative heat exchanger should be activated:

obtaining a temperature of the pre-cooled air that exits the indirect evaporative heat exchanger for cooling the condenser coil; and modulating a louvre that controls a portion of the pre-cooled air that is recirculated through the indirect evaporative heat exchanger through a plurality of secondary channels such that the temperature of the pre-cooled air is maintained at least a predetermined amount above a dew point temperature.

17. The method of claim 16, wherein the determination that the indirect evaporative heat exchanger should be activated comprises determining at least one of (a) that a temperature of ambient air exceeds a threshold temperature, or (b) that a dew point depression exceeds a threshold dew point depression.

18. The method of claim 16, wherein the dew point temperature is a current dew point temperature of ambient air.

19. The method of claim 16, wherein the method further comprises, responsive to the determination that the indirect evaporative heat exchanger should be activated:

activating a water tank to provide moisture to the plurality of secondary channels, wherein the recirculation of the pre-cooled air through the plurality of secondary channels induces indirect evaporative cooling of air travelling through a plurality of dry channels of the indirect evaporative heat exchanger.

20. The method of claim 16, wherein modulating the louvre comprises performing a closed loop control scheme to maintain the temperature of the pre-cooled air at least the predetermined amount above the dew point temperature.

* * * * *